US009389573B2

(12) United States Patent
Okada et al.

(10) Patent No.: US 9,389,573 B2
(45) Date of Patent: Jul. 12, 2016

(54) IMAGE FORMING APPARATUS, IMAGE FORMING METHOD, AND COMPUTER-READABLE STORAGE MEDIUM

(71) Applicants: Norikazu Okada, Kanagawa (JP); Takaaki Shirai, Tokyo (JP); Takuma Kasai, Kanagawa (JP); Keita Maejima, Kanagawa (JP); Tomoyuki Yamashita, Tokyo (JP); Ryohta Kubokawa, Kanagawa (JP); Satoru Tao, Kanagawa (JP); Homare Ehara, Kanagawa (JP)

(72) Inventors: Norikazu Okada, Kanagawa (JP); Takaaki Shirai, Tokyo (JP); Takuma Kasai, Kanagawa (JP); Keita Maejima, Kanagawa (JP); Tomoyuki Yamashita, Tokyo (JP); Ryohta Kubokawa, Kanagawa (JP); Satoru Tao, Kanagawa (JP); Homare Ehara, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/745,828

(22) Filed: Jun. 22, 2015

(65) Prior Publication Data

US 2015/0370216 A1 Dec. 24, 2015

(30) Foreign Application Priority Data

Jun. 23, 2014 (JP) ..... 2014-128585

(51) Int. Cl.
*G03G 15/00* (2006.01)
*G03G 15/20* (2006.01)

(52) U.S. Cl.
CPC ..... *G03G 15/80* (2013.01); *G03G 15/2039* (2013.01)

(58) Field of Classification Search
CPC ..... G03G 15/80; G03G 15/2039
USPC ..... 399/88, 82, 37
See application file for complete search history.

(56) References Cited

U.S. PATENT DOCUMENTS

2002/0036911 A1* 3/2002 Okui ..... H02J 9/062 363/95
2004/0022550 A1 2/2004 Okada
2006/0133846 A1* 6/2006 Okamoto ..... G03G 15/80 399/88
2006/0159482 A1 7/2006 Okada
2007/0031159 A1* 2/2007 Kishi ..... G03G 15/2039 399/69
2008/0155294 A1 6/2008 Kikuchi et al.
2009/0238595 A1 9/2009 Okada
2010/0254726 A1* 10/2010 Endo ..... G03G 15/2039 399/88 X
2013/0188979 A1 7/2013 Okada
2014/0354208 A1* 12/2014 Kira ..... H02P 29/0005 318/635
2015/0220044 A1* 8/2015 Tatsumoto ..... G03G 15/80 399/88 X
2015/0311731 A1* 10/2015 Tatsumoto ..... G03G 15/80 399/88 X

FOREIGN PATENT DOCUMENTS

JP 2008-176288 7/2008

* cited by examiner

*Primary Examiner* — Sophia S Chen
(74) *Attorney, Agent, or Firm* — Harness, Dickey & Pierce, P.L.C.

(57) ABSTRACT

An image forming apparatus includes a heat generator configured to generate heat in the image forming apparatus; a converter including a capacitor to convert AC power supplied from an external power supply into DC power for a load unit; a thermoelectric transducer configured to convert the generated heat into DC power for the load unit; a detector configured to detect a voltage of the AC power; and a controller configured to cause the converter to continue supplying the DC power to the load unit when a first elapsed time elapsed since the detected voltage drops below a rated voltage is shorter than a first time period shorter than an upper limit of a period of time over which the capacitor is dischargeable, and cause the thermoelectric transducer to supply the DC power to the load unit when the first elapsed time exceeds the first time period.

8 Claims, 9 Drawing Sheets

FIG.6

| DETECTED AC VOLTAGE | | ENERGY SAVING MODE | STANDBY MODE | IN-SERVICE MODE |
|---|---|---|---|---|
| ≤ 75 VAC | FIRST TIME PERIOD | 0.7 seconds | 0.6 seconds | 0.4 seconds |
| | SECOND TIME PERIOD | 0 seconds | 0.3 seconds | 0.5 seconds |
| ≤ 45 VAC | FIRST TIME PERIOD | 0.55 seconds | 0.45 seconds | 0.25 seconds |
| | SECOND TIME PERIOD | 0 seconds | 0.3 seconds | 0.5 seconds |
| ≤ 15 VAC | FIRST TIME PERIOD | 0.4 seconds | 0.3 seconds | 0.1 seconds |
| | SECOND TIME PERIOD | 0 seconds | 0.3 seconds | 0.5 seconds |

FIG.7

| DETECTED AC VOLTAGE | ENERGY SAVING MODE | STANDBY MODE | IN-SERVICE MODE |
|---|---|---|---|
| | FIRST ELAPSED TIME | FIRST ELAPSED TIME | SHORTER ONE OF FIRST ELAPSED TIME AND 1.0 seconds |

FIG.8

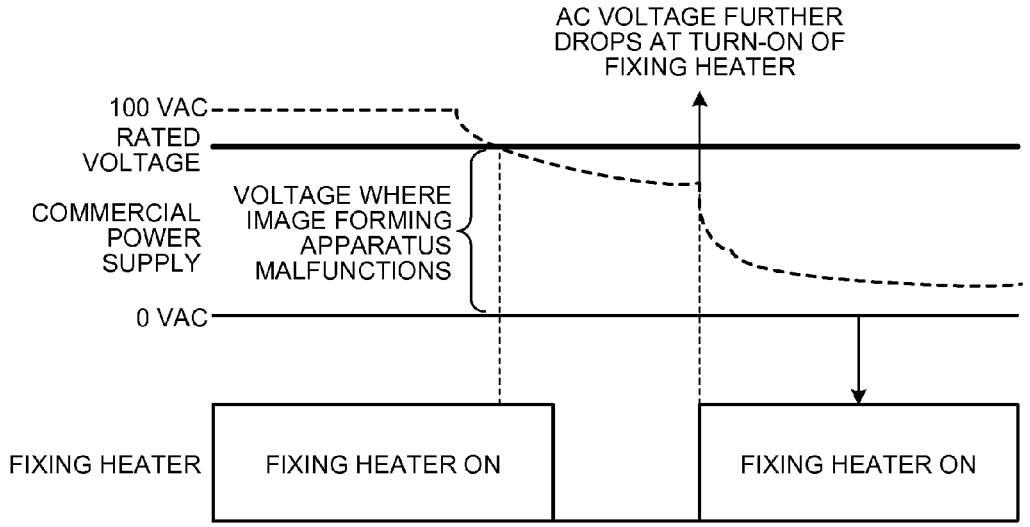

FIG.9

| DETECTED AC VOLTAGE | | ENERGY SAVING MODE | STANDBY MODE | IN-SERVICE MODE |
|---|---|---|---|---|
| ≤ 75 VAC | FIRST TIME PERIOD | 0.7 seconds | 0.6 seconds | 0.4 seconds |
| | SECOND TIME PERIOD | 0 seconds | AT FIXING TEMPERATURE OF 150°C: 0.4 seconds<br>AT FIXING TEMPERATURE OF 140°C: 0.3 seconds | 0.5 seconds |
| ≤ 45 VAC | FIRST TIME PERIOD | 0.55 seconds | 0.45 seconds | 0.25 seconds |
| | SECOND TIME PERIOD | 0 seconds | AT FIXING TEMPERATURE OF 150°C: 0.4 seconds<br>AT FIXING TEMPERATURE OF 140°C: 0.3 seconds | 0.5 seconds |
| ≤ 15 VAC | FIRST TIME PERIOD | 0.4 seconds | 0.3 seconds | 0.1 seconds |
| | SECOND TIME PERIOD | 0 seconds | AT FIXING TEMPERATURE OF 150°C: 0.4 seconds<br>AT FIXING TEMPERATURE OF 140°C: 0.3 seconds | 0.5 seconds |

IMAGE FORMING APPARATUS, IMAGE FORMING METHOD, AND COMPUTER-READABLE STORAGE MEDIUM

CROSS-REFERENCE TO RELATED APPLICATION

The present application claims priority to and incorporates by reference the entire contents of Japanese Patent Application No. 2014-128585 filed in Japan on Jun. 23, 2014.

BACKGROUND OF THE INVENTION

1. Field of the Invention

The present invention relates generally to an image forming apparatus, an image forming method, and a computer-readable storage medium.

2. Description of the Related Art

Electrophotographic image forming apparatuses typically use wall-outlet power supply (commercial power supply) as external power source. The commercial power supply is electrical power supplied from a power plant of an electric-power company to indoor electrical appliances and the like through transmission lines. If a transmission line, power distribution equipment, or the like of the commercial power supply is struck by lightning or animal or bird contact, the voltage of the commercial power supply can drop instantaneously (which may be referred to as "instantaneous voltage drop"). This instantaneous voltage drop can cause a trouble such as malfunction or outage of an indoor electrical appliance, which may be an electrophotographic image forming apparatus. Some type of electrical appliances such as electrophotographic image forming apparatuses is configured to tolerate instantaneous voltage drop in the commercial power supply for a short period of time, e.g., 10 ms (milliseconds), by employing a capacitor such as an electrolytic capacitor with large capacitance in a converter of a built-in switched-mode power supply device such as a PSU (power supply unit). Some type of electrical appliances such as electrophotographic image forming apparatuses is configured to tolerate even a long-duration power failure of 20 milliseconds or longer, for example, by including or externally connected to an uninterruptible power supply device.

Conventionally, such an electrophotographic image forming apparatus is generally configured to receive power supply from a switched-mode power supply device built in the image forming apparatus until the built-in switched-mode power supply device reaches its power-supply capability limit. However, there is a variation in the power-supply capability of the built-in switched-mode power supply device at occurrence of instantaneous voltage drop. This variation can prevent smooth, malfunction-free switching of power supply source from the built-in switched-mode power supply device to a power storage unit. Furthermore, such a conventional electrophotographic image forming apparatus requires that the power supply source should be switched from the built-in switched-mode power supply device to the power storage unit immediately upon occurrence of instantaneous voltage drop so that the power supply source can be switched smoothly. However, this leads to wasting consumption of the expensive power storage unit having a limited usable life.

Therefore, there is a need for an image forming apparatus, an image forming method, and a computer-readable storage medium, capable of prolonging the usable life of the expensive power storage unit by using a power storage unit having a limited usable life less frequently.

SUMMARY OF THE INVENTION

It is an object of the present invention to at least partially solve the problems in the conventional technology.

According to an embodiment, there is provided an image forming apparatus that includes a heat generator configured to generate heat depending on operation of the image forming apparatus; a converter configured to convert AC power supplied from an external power supply into DC power and including a capacitor for smoothing the DC power, the converter being configured to supply the smoothed DC power to a load unit; a thermoelectric transducer configured to convert the heat generated by the heat generator into DC power and supply the DC power to the load unit in place of the converter; a detector configured to detect a voltage of the AC power supplied from the external power supply; and a controller configured to, when a first elapsed time that is a period of time elapsed since the voltage detected by the detector drops to or below a rated voltage is equal to or shorter than a first time period that is shorter than an upper limit of a period of time over which the capacitor is dischargeable, cause the converter to continue supplying the DC power to the load unit, and when the first elapsed time exceeds the first time period, cause the thermoelectric transducer to supply the DC power to the load unit.

According to another embodiment, there is provided an image forming method performed in an image forming apparatus that includes a heat generator configured to generate heat depending on operation of the image forming apparatus, a converter configured to convert AC power supplied from an external power supply into DC power and including a capacitor for smoothing the DC power, the converter being configured to supply the smoothed DC power to a load unit, and a thermoelectric transducer configured to convert the heat generated by the heat generator into DC power and supply the DC power to the load unit in place of the converter. The image forming method includes detecting a voltage of the AC power supplied from the external power supply; causing, when a first elapsed time that is a period of time elapsed since the detected voltage drops to or below a rated voltage is equal to or shorter than a first time period that is shorter than an upper limit of a period of time over which the capacitor is dischargeable, the converter to continue supplying the DC power to the load unit; and causing, when the first elapsed time exceeds the first time period, the thermoelectric transducer to supply the DC power to the load unit.

According to still another embodiment, there is provided a non-transitory computer-readable storage medium with an executable program stored thereon and executed by a computer for controlling an image forming apparatus that includes a heat generator configured to generate heat depending on operation of the image forming apparatus, a converter configured to convert AC power supplied from an external power supply into DC power and including a capacitor for smoothing the DC power, the converter being configured to supply the smoothed DC power to a load unit, and a thermoelectric transducer configured to convert the heat generated by the heat generator into DC power and supply the DC power to the load unit in place of the converter. The program instructs the processor to perform: detecting a voltage of the AC power supplied from the external power supply; causing, when a first elapsed time that is a period of time elapsed since the detected voltage drops to or below a rated voltage is equal to or shorter than a first time period that is shorter than an upper limit of a period of time over which the capacitor is dischargeable, the converter to continue supplying the DC power to the load unit; and causing, when the first elapsed time exceeds the first time period, the thermoelectric transducer to supply the DC power to the load unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a diagram illustrating examples of a first time period and a second time period set by the image forming apparatus according to the embodiment;

FIG. 7 is a diagram for describing control of a fixing heater in the image forming apparatus according to the embodiment;

FIG. 8 is a timing diagram of a process for controlling the fixing heater in the image forming apparatus according to the embodiment;

FIG. 9 is a diagram for describing a process for setting the second time period performed by the image forming apparatus according to the embodiment;

DETAILED DESCRIPTION OF THE PREFERRED EMBODIMENTS

Exemplary embodiments of the present invention are described in detail below with reference to the accompanying drawings.

An image forming apparatus 1 (see FIG. 1) according to an embodiment is a digital multifunction peripheral or the like having multiple selectable functions including a copier function, a printer function, and a facsimile function. When the copier function is selected, the image forming apparatus 1 enters a copier mode. When the printer function is selected, the image forming apparatus 1 enters a printer mode. When the facsimile function is selected, the image forming apparatus 1 enters a facsimile mode.

Figure 1:
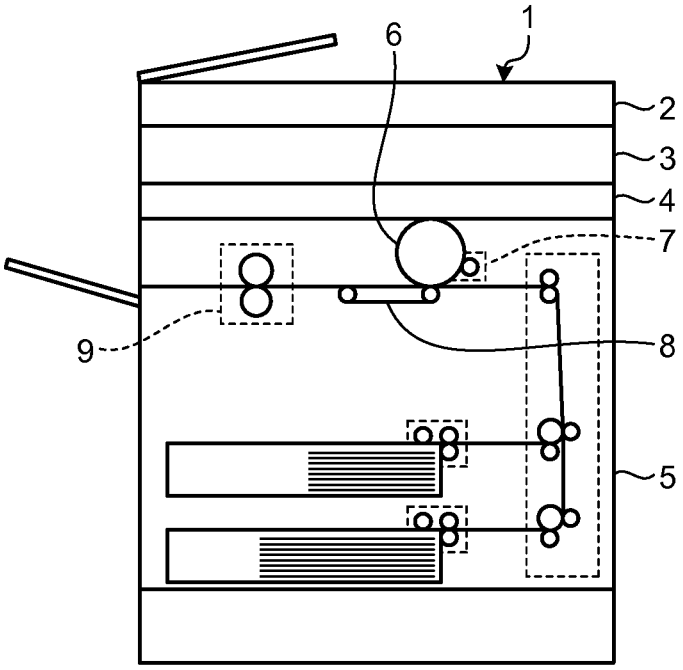
FIG. 1 is a diagram illustrating a schematic configuration of an image forming apparatus according to an embodiment.

With reference to FIG. 1, a procedure for forming an image performed by the image forming apparatus 1 according to the embodiment is briefly described below. FIG. 1 is a diagram illustrating a schematic configuration of the image forming apparatus 1 according to the embodiment. In the embodiment, the image forming apparatus 1 includes an ADF (automatic document feeder) 2, an image reading device 3, a writing unit 4, and a printer unit 5.

When the image forming apparatus 1 enters the copier mode, for example, the ADE 2 feeds an original document (hereinafter, simply referred to as "document") to be copied to the image reading device 3. The image reading device 3 (an example of "heat generator" which generates heat depending on operation of the image forming apparatus 1) reads an image of the document fed from the ADF 2. The image reading device 3 transmits image information representing the read image to the writing unit 4 via an image processor (not shown). The writing unit 4 irradiates a photoconductor drum 6 that is uniformly electrostatically charged by an electrostatic charger (not shown) with light in accordance with the image information received from the image reading device 3. The writing unit 4 thus forms an electrostatic latent image on the photoconductor drum 6.

The printer unit 5 includes the photoconductor drum 6, a developing device 7, a conveying belt 8, and a fixing device 9. The developing device 7 develops the electrostatic latent image formed on the photoconductor drum 6 into a toner image. The conveying belt 8 conveys transfer paper to a position where the transfer paper faces the toner image on the photoconductor drum 6 and transfers the toner image onto the transfer paper. The fixing device 9 heats the toner image transferred onto the transfer paper to fix the toner image and ejects the transfer paper where the toner image is fixed.

Figure 2:
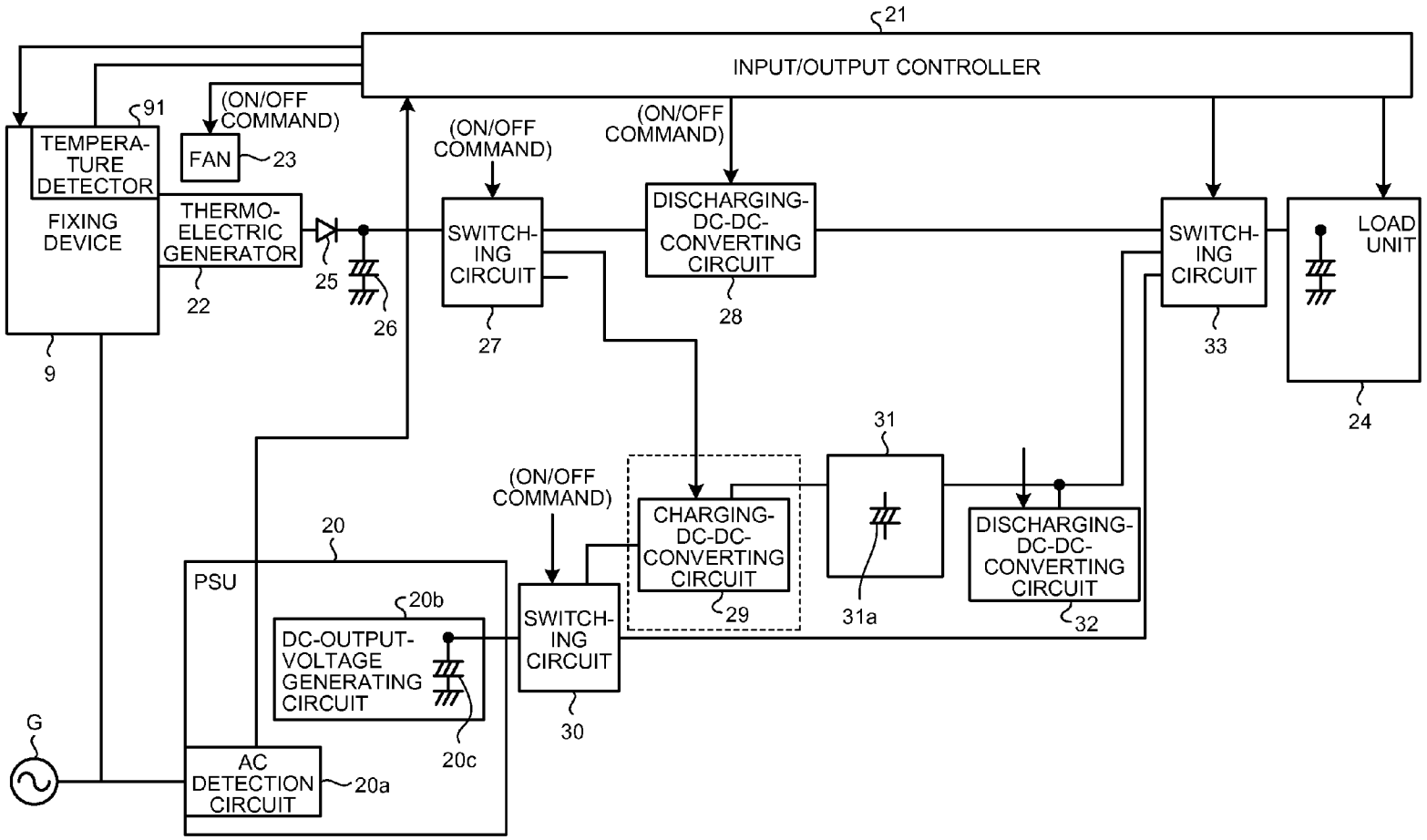
FIG. 2 is a block diagram illustrating an electrical configuration of the image forming apparatus according to the embodiment.

With reference to FIG. 2, an electrical configuration of the image forming apparatus 1 according to the embodiment is described below. FIG. 2 is a block diagram illustrating the electrical configuration of the image forming apparatus 1 according to the embodiment.

The image forming apparatus 1 according to the embodiment includes an input/output controller 21 that controls the entire image forming apparatus 1. The image forming apparatus 1 according to the embodiment is connected to a commercial power supply G (an example of "external power supply") via a plug socket or the like on external equipment. The commercial power supply G supplies alternating-current electric power (hereinafter, "AC power") to both the fixing device 9 and a PSU (power supply unit) 20 in the image forming apparatus 1.

The fixing device 9 includes a fixing heater (an example of "heat generator" which generates heat depending on operation of the image forming apparatus 1) that generates heat by the AC power supplied from the commercial power supply G, thereby fixing a toner image formed on a recording medium such as transfer paper, and a driver circuit that drives the fixing heater. The fixing device 9 further includes a temperature detector 91 (e.g., a direct-contact thermistor or a noncontact sensor) that detects an internal temperature of the fixing device 9 (or the fixing heater (not shown)) and inputs the detected temperature to the input/output controller 21, which will be described later. The input/output controller 21 controls on/off of the fixing heater based on the temperature detected by the temperature detector 91 so as to maintain the fixing heater at a predetermined target temperature.

A thermoelectric generator 22 and a fan 23 are arranged near the fixing device 9. A Seebeck generator, for example, may be used as the thermoelectric generator 22 (an example of "thermoelectric transducer"). The thermoelectric generator 22 can convert heat generated by the fixing heater (not shown) into direct-current electric power (hereinafter, "DC power") and supply the DC power to a load unit 24 (e.g., the ADF 2, the image reading device 3, the writing unit 4, or the printer unit 5) by taking the place of the PSU 20 (more specifically, a DC-output-voltage generating circuit 20*b* which will be described later). In the embodiment, the thermoelectric generator 22 converts heat generated by the fixing heater included in the fixing device 9 into DC power; however, heat to be converted is not limited thereto. Alternatively, the thermoelectric generator 22 converts heat generated by a heat generator of the image reading device 3 or the like into DC power. The fan 23 is turned on or off in accordance with an on/off command fed from the input/output controller 21 to cool the thermoelectric generator 22.

A diode 25 and a smoothing capacitor 26 are connected to the thermoelectric generator 22. The diode 25 prevents reverse current to the thermoelectric generator 22. The smoothing capacitor 26 reduces ripple in the voltage applied from the thermoelectric generator 22 to the load unit 24 or the like. In other words, the smoothing capacitor 26 smooths electric current flowing from the thermoelectric generator 22 to the load unit 24.

The image forming apparatus 1 according to the embodiment includes a switching circuit 27 that switches a receiver of the DC power supplied from the thermoelectric generator 22 among a discharging-DC-DC-converting circuit 28, a charging-DC-DC-converting circuit 29, and "none". The switching circuit 27 switches the receiver of the DC power supplied from the thermoelectric generator 22 in accordance with an on/off command fed from the input/output controller 21. Under a normal condition where no on/off command is fed from the input/output controller 21, the switching circuit 27 switches the receiver of the DC power supplied from the thermoelectric generator 22 to "none".

When the DC power from the thermoelectric generator 22 is to be supplied to the load unit 24, the discharging-DC-DC-converting circuit 28 converts the DC power from the thermoelectric generator 22 to DC power having a preset voltage and supplies the converted DC power to the load unit 24. The charging-DC-DC-converting circuit 29 converts the DC power from the thermoelectric generator 22 (or from the DC-output-voltage generating circuit 20*b* which will be described later) to DC power having a preset voltage and supplies the converted DC power to a power storage unit 31.

The power storage unit 31 includes a chargeable battery 31*a* which can be a lithium ion battery or the like and charges the chargeable battery 31*a* with the DC power supplied from the charging-DC-DC-converting circuit 29. The power storage unit 31 is also capable of supplying power (DC power) stored in the chargeable battery 31*a* to the load unit 24 via a discharging-DC-DC-converting circuit 32 by taking the place of the thermoelectric generator 22. The discharging-DC-DC-converting circuit 32 converts the DC power supplied from the power storage unit 31 to DC power having a preset voltage and supplies the converted DC power to the load unit 24.

The FSU 20 includes an AC detection circuit 20*a* (an example of "detector") and the DC-output-voltage generating circuit 20*b* (an example of "converter"). The AC detection circuit 20*a* detects a voltage of the AC power supplied from the commercial power supply G. The DC-output-voltage generating circuit 20*b* converts the AC power supplied from the commercial power supply C into DC power, smooths the DC power using a capacitor 20*c*, and supplies the smoothed DC power to the load unit 24.

In the embodiment, the AC detection circuit 20*a* converts an AC voltage, which is the voltage of the AC power supplied from the commercial power supply G, into a DC voltage and outputs the DC voltage to the input/output controller 21. The input/output controller 21 can detect the AC voltage of the AC power supplied from the commercial power supply G based on the DC voltage output from the AC detection circuit 20*a*.

In the embodiment, the DC-output-voltage generating circuit 20*b* converts the AC power supplied from the commercial power supply G into DC power having a preset DC voltage (e.g., 5 V (volts) or 24 V) and supplies the converted DC power to the charging-DC-DC-converting circuit 29 or the load unit 24. In the embodiment, receiver of the DC power supplied from the DC-output-voltage generating circuit 20*b* is switched by a switching circuit 30. The switching circuit 30 switches the receiver of the DC power supplied from the DC-output-voltage generating circuit 20*b* between the charging-DC-DC-converting circuit 29 and the load unit 24 in accordance with an on/off command fed from the input/output controller 21.

The image forming apparatus 1 according to the embodiment includes a switching circuit 33 interposed between the load unit 24 and the DC-power supply sources (the DC-output-voltage generating circuit 20*b*, the thermoelectric generator 22, and the power storage unit 31) for the load unit 24. The switching circuit 33 switches DC-power supply source for the load unit 24 under control of the input/output controller 21.

Figure 3:
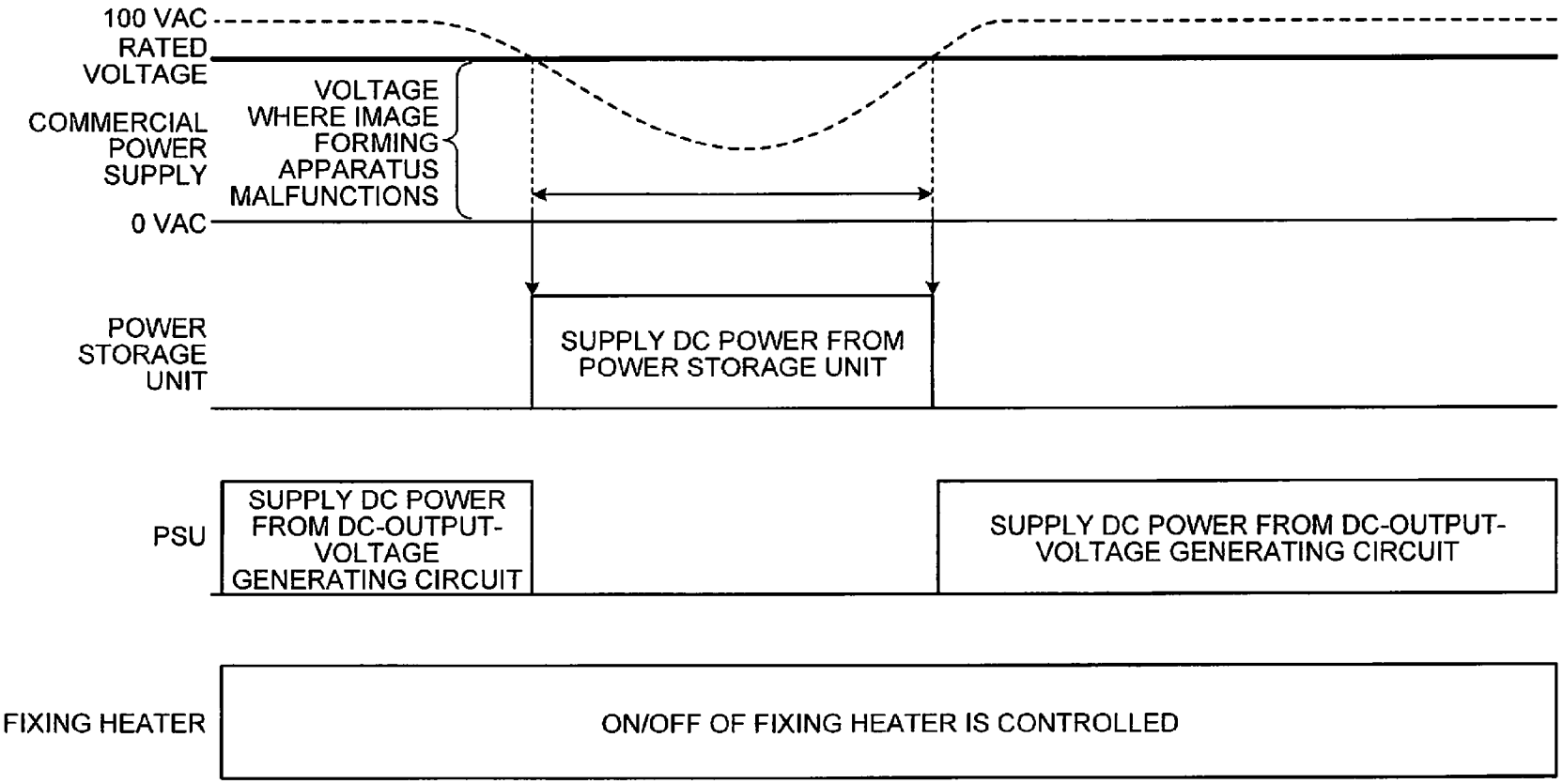
FIG.3 Prior Art
FIG. 3 is a timing diagram illustrating a process for supplying DC power to a load unit performed by a conventional image forming apparatus.
Figure 4:
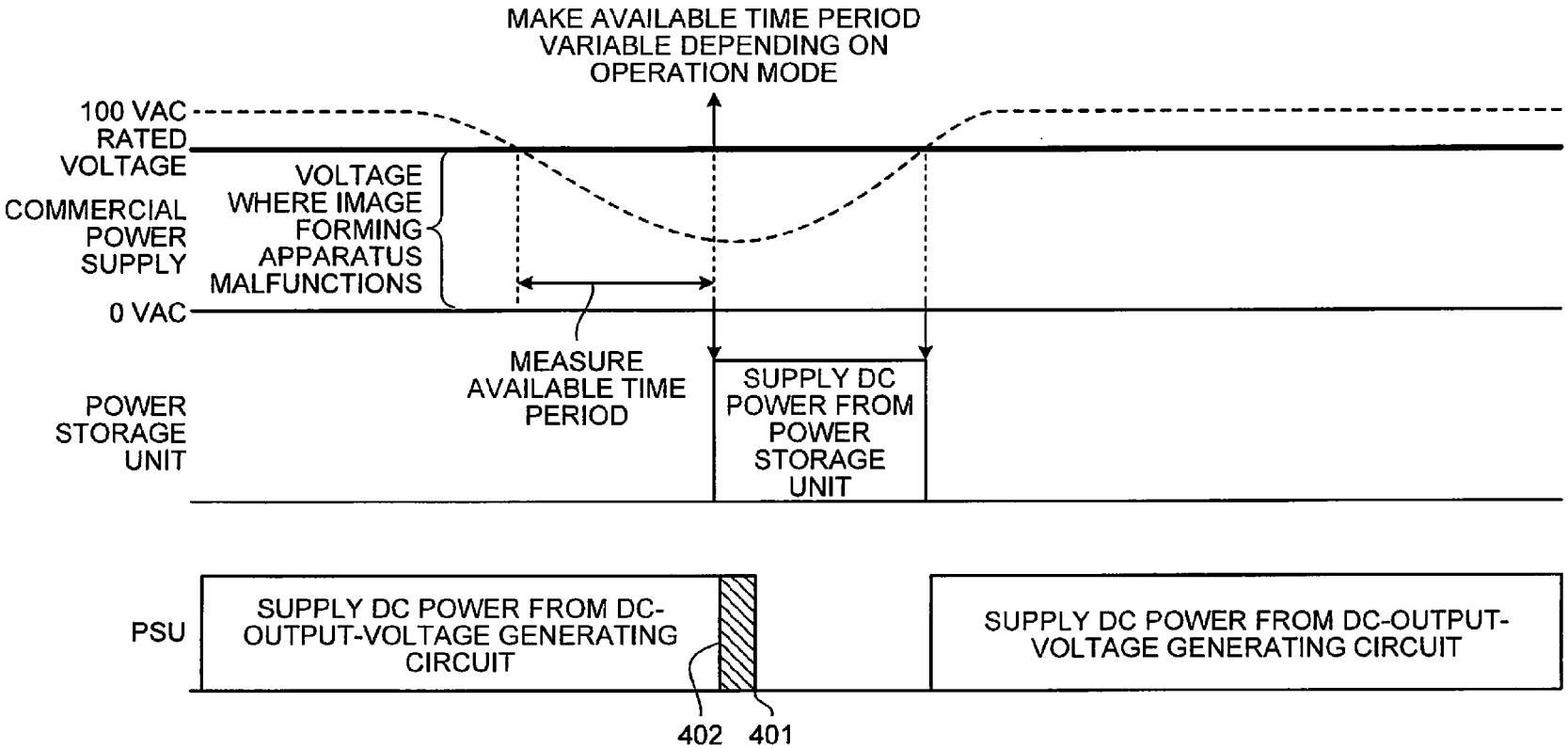
FIG.4 Prior Art
FIG. 4 is a timing diagram illustrating another process for supplying DC power to the load unit performed by the conventional image forming apparatus.

Examples of the process for supplying DC power to the load unit 24 performed by conventional image forming apparatuses are described below. FIGS. 3 and 4 are timing diagrams illustrating examples of the process for supplying DC power to the load unit 24 performed by a conventional image forming apparatus.

An example of the process for supplying DC power to the load unit 24 performed by the conventional image forming apparatus is described below with reference to FIG. 3. It is assumed that an AC voltage (e.g., 100 VAC) of the AC power supplied from the commercial power supply G is applied to the image forming apparatus in a normal condition. As illustrated in FIG. 3, the input/output controller 21 of the conventional image forming apparatus controls the switching circuits 27, 30, and 33 so that DC power is supplied from the PSU 20 (more specifically, the DC-output-voltage generating circuit 20*b*) to the load unit 24 over a period when the AC voltage detected by the AC detection circuit 20*a* is higher than a rated voltage (e.g., 75 VAC) where it is guaranteed that the image forming apparatus operates normally.

On the other hand, as illustrated in FIG. 3, when the AC voltage detected by the AC detection circuit 20*a* is decreased to or below the rated voltage by lightning striking or animal or bird contact on a transmission line of the commercial power supply G, the input/output controller 21 controls the switching circuit 33 so that DC power is supplied to the load unit 24 from the power storage unit 31 in lieu of from the commercial power supply G. Thus, in the conventional image forming apparatus, when the AC voltage drops to or below the predetermined rated voltage, power supply source for the load unit 24 is immediately switched to the power storage unit 31 even if the capacitor 20*c* of the DC-output-voltage generating circuit 20*b* of the PSU 20 is charged and power supply from the PSU 20 (more specifically, the capacitor 20*c*) is continuable. Accordingly, in the conventional image forming apparatus, because the power supply source for the load unit 24 is frequently switched to the power storage unit 31, usage time and frequency of use of the power storage unit 31 increase, by which usable life of the power storage unit 31 is shortened.

Another example of the process for supplying DC power to the load unit 24 performed by a conventional image forming apparatus is described below with reference to FIG. 4. As illustrated in FIG. 4, in the conventional image forming apparatus, the input/output controller 21 measures (calculates) in advance an available time period which is upper limit of a period of time over which the PSU 20 (more specifically, the capacitor 20*c*) is dischargeable. The input/output controller 21 makes the available time period variable depending on the operation mode (e.g., the copier mode, the printer mode, or the facsimile mode) of the image forming apparatus. As illustrated in FIG. 4, when the AC voltage detected by the AC detection circuit 20*a* is decreased to or below the rated voltage by lightning striking or animal or bird contact on a transmission line of the commercial power supply G, the input/output controller 21 continues supplying power to the load unit 24 from the PSU 20 (the capacitor 20*c*) for the available time period after the AC voltage drops to or below the rated voltage.

Thereafter, as illustrated in FIG. 4, when the available time period has elapsed since when the AC voltage has dropped to or below the rated voltage, the input/output controller 21 switches the power supply source for the load unit 24 from the PSU 20 to the power storage unit 31. With this control, the power supply source for the load unit 24 is switched to the power storage unit 31 only when the condition where the AC voltage is equal to or below the rated voltage is maintained for the available time period. Accordingly, usage time and frequency of use of the power storage unit 31 can be reduced. However, if the available time period is prolonged as indicated by reference numeral 401, power supply from the PSU 20 can be unstable. On the other hand, if the available time period is shortened as indicated by reference numeral 402, usage time and frequency of use of the power storage unit 31 increase, by which the usable life of the power storage unit 31 is shortened.

Figure 5:
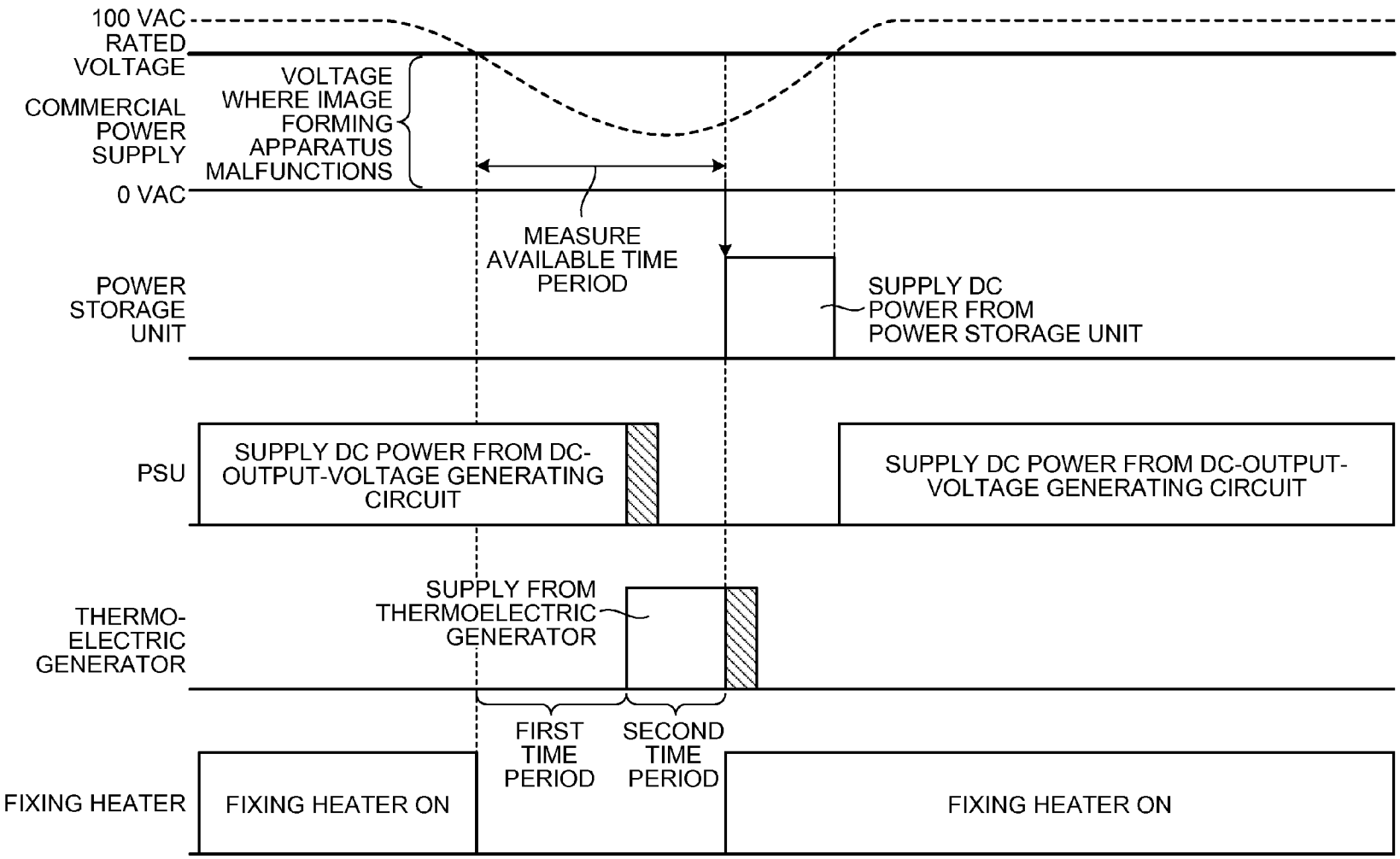
FIG. 5 is a timing diagram illustrating a process for supplying power to a load unit performed by the image forming apparatus according to the embodiment.

A process for supplying DC power to the load unit 24 performed by the image forming apparatus 1 according to the embodiment is described below with reference to FIG. 5. FIG. 5 is a timing diagram illustrating the process for supplying power to the load unit 24 performed by the image forming apparatus 1 according to the embodiment.

In the image forming apparatus 1 according to the embodiment, the input/output controller 21 measures (calculates) in advance an available time period, which is an upper limit of a period of time over which the PSU 20 (more specifically, the capacitor 20*c*) is dischargeable. The input/output controller 21 sets a predetermined first time period. The first time period is a period of time between when the AC voltage detected by the AC detection circuit 20*a* drops to or below the rated voltage and when the DC-power supply source for the load unit 24 is switched to the thermoelectric generator 22 and is shorter than the calculated available time period. In the embodiment, the input/output controller 21 can change the first time period depending on the operation mode of the image forming apparatus 1. Furthermore, in the embodiment, the input/output controller 21 sets a predetermined second time period. The second time period is a period of time between when the thermoelectric generator 22 starts supplying power to the load unit 24 and when DC-power supply source for the load unit 24 is switched to the power storage unit 31.

As illustrated in FIG. 5, when a period of time (hereinafter, "first elapsed time") elapsed since the AC voltage (between 45 V and 75 V, for example) detected by the AC detection circuit 20*a* drops to or below the rated voltage (e.g., 75 V) is equal to or shorter than the first time period, the input/output controller 21 (an example of "controller") controls the switching circuits 27, 30, and 33 so as to maintain connection between the DC-output-voltage generating circuit 20*b* and the load unit 24, thereby causing the DC-output-voltage generating circuit 20*b* to continue supplying DC power to the load unit 24. Thereafter, as illustrated in FIG. 5, when the first elapsed time exceeds the first time period, the input/output controller 21 controls the switching circuits 27, 30, and 33 so as to connect the thermoelectric generator 22 to the load unit 24, thereby causing DC power to be supplied to the load unit 24 from the thermoelectric generator 22 in lieu of from the PSU 20. Supplying power in this manner prevents the DC-power supply source for the load unit 24 from being switched to the power storage unit 31 immediately when the AC voltage of the commercial power supply G drops to or below the rated voltage. Accordingly, because usage time and frequency of use of the power storage unit 31 are reduced, usable life of the power storage unit 31 can be prolonged, and running cost of the power storage unit 31 can be reduced.

Furthermore, as illustrated in FIG. 5, when a period of time (hereinafter, "second elapsed time") elapsed since the thermoelectric generator 22 starts supplying DC power to the load unit 24 with the AC voltage detected by the AC detection circuit 20*a* remaining at or below the rated voltage reaches the second time period, the input/output controller 21 controls the switching circuit 33 so as to connect the power storage unit 31 to the load unit 24, thereby causing DC power to be supplied to the load unit 24 from the power storage unit 31 in lieu of from the thermoelectric generator 22.

In Japan, time duration of 90 percent or more of instantaneous voltage drops, which are instantaneous drops in the voltage of the commercial power supply G, is not longer than 0.5 seconds. Accordingly, so long as the sum of the first time period and the second time period is set to 0.5 seconds or longer, the need for supplying power from the power storage unit 31 is eliminated from the input/output controller 21. As a result, because usage time and frequency of use of the power storage unit 31 are reduced, usable life of the power storage unit 31 can be prolonged, and running cost of the power storage unit 31 can be reduced.

Examples of the first time period and the second time period set by the image forming apparatus 1 according to the embodiment are described below with reference to FIG. 6. FIG. 6 is a diagram illustrating examples of the first time period and the second time period set by the image forming apparatus 1 according to the embodiment.

As described earlier, the first time period is the period of time between when the AC voltage drops to or below the rated voltage and when the DC-power supply source for the load unit 24 is switched from the PSU 20 (more specifically, the DC-output-voltage generating circuit 20*b*) to the thermoelectric generator 22. Hence, the first time period is a period of time during which stable DC power can be supplied from the DC-output-voltage generating circuit 20*b* after the AC voltage drops to or below the rated voltage. In the embodiment, the input/output controller 21 reduces the first time period depending on operation mode such that, as the load of the load unit 24 increases (for example, in the following order: energy saving mode<standby mode<in-service mode), the first time period becomes shorter.

More specifically, as illustrated in FIG. 6, the input/output controller 21 causes the first time period of the image forming apparatus 1 operating in the energy saving mode (an example of "first mode") to be longer than that of the image forming apparatus 1 operating in the standby mode (an example of "second mode") where load of the load unit 24 is larger than that in the energy saving mode or, put another way, power consumption of the load unit 24 is larger than that in the energy saving mode. In the example illustrated in FIG. 6, the first time period for the energy saving mode is set as follows: 0.7 seconds (for the AC voltage of 75 V or lower), 0.55 seconds (for the AC voltage of 45 V or lower), and 0.4 seconds (for the AC voltage of 15 V or lower); the first time period for the standby mode is set as follows: 0.6 seconds (for the AC voltage of 75 V or lower), 0.45 seconds (for the AC voltage of 45 V or lower), and 0.3 seconds (for the AC voltage of 15 V or lower).

As illustrated in FIG. 6, the input/output controller 21 causes the first time period of the image forming apparatus 1 operating in the standby mode (an example of "first mode") to be longer than that of the image forming apparatus 1 operating in the in-service mode (an example of "second mode") where printing or the like is performed and therefore power consumption of the load unit 24 is larger than that in the standby mode. In the example illustrated in FIG. 6, the first time period for the standby mode is set as follows: 0.6 seconds (for the AC voltage of 75 V or lower), 0.45 seconds (for the AC voltage of 45 V or lower), and 0.3 seconds (for the AC voltage of 15 V or lower); the first time period for the in-service mode is set as follows: 0.4 seconds (for the AC voltage of 75 V or lower), 0.25 seconds (for the AC voltage of 45 V or lower), and 0.1 seconds (for the AC voltage of 15 V or lower). These settings allow, when the image forming apparatus 1 is operating in a low-load mode, reducing usage time and frequency of use of the power storage unit 31 by increasing the period of time during which DC power is supplied from the thermoelectric generator 22 to the load unit 24. As a result, usable life of the power storage unit 31 can be prolonged.

In the embodiment, the input/output controller 21 reduces the first time period depending on the operation mode such that, as the load of the load unit 24 increases, the first time period becomes shorter. Alternatively, the input/output controller 21 may change the first time period depending on a DC voltage, which is the voltage of the DC power supplied from the DC-output-voltage generating circuit 20*b*. More specifically, this modification may be implemented by adding a voltage detector capable of detecting the DC voltage of the DC power supplied from the DC-output-voltage generating circuit 20*b* to the image forming apparatus 1. The input/output controller 21 reduces the first time period when the DC voltage detected by the voltage detector is equal to or below a predetermined voltage. For example, the input/output controller 21 may reduce the first time period when the DC voltage (which may be 24 V in a normal condition) of the DC power supplied from the DC-output-voltage generating circuit 20*b* drops to or below a predetermined voltage (e.g., 21.6 V which is 10 percent lower than 24 V, the DC voltage in the normal condition).

As described earlier, the second time period is the period of time between when the thermoelectric generator 22 starts supplying DC power to the load unit 24 and when the DC-power supply source for the load unit 24 is switched from the thermoelectric generator 22 to the power storage unit 31. In the embodiment, the input/output controller 21 increases the second time period depending on the operation mode such that, as the amount of heat generated by the fixing heater included in the fixing device 9 increases, the second time period becomes longer.

More specifically, as illustrated in FIG. 6, when the temperature of the fixing heater included in the fixing device 9 is not controlled (in other words, when the fixing heater is not generating heat) and the image forming apparatus 1 is operating in the energy saving mode where DC power cannot be supplied from the thermoelectric generator 22, the input/output controller 21 sets the second time period to 0.0 s regardless of the AC voltage.

As illustrated in FIG. 6, when the temperature of the fixing heater included in the fixing device 9 is controlled (in other words, the fixing heater is generating heat) in the standby mode or the in-service mode and the image forming apparatus 1 is operating in the standby mode or the in-service mode where DC power can be supplied from the thermoelectric generator 22, the input/output controller 21 sets the second time period to 0.1 seconds or longer. At this time, as illustrated in FIG. 6, because the amount of heat generated by the thermoelectric generator 22 in the in-service mode is larger than that in the standby mode, the input/output controller 21 causes the second time period for the standby mode to be longer than that in the in-service mode. In the example illustrated in FIG. 6, the second time period for the standby mode is set as follows: 0.3 seconds (for the AC voltage of 75 V or lower), 0.3 seconds (for the AC voltage of 45 V or lower), and 0.3 seconds (for the AC voltage of 15 V or lower); the second time period for the in-service mode is set as follows: 0.5 seconds (for the AC voltage of 75 V or lower), 0.5 seconds (for the AC voltage of 45 V or lower), and 0.5 seconds (for the AC voltage of 15 V or lower).

In the embodiment, the thermoelectric generator 22 converts heat (waste heat) generated by the fixing heater included in the fixing device 9 into DC power and supplies, by taking the place of the DC-output-voltage generating circuit 20*b*, the DC power to the load unit 24. Alternatively, the thermoelectric generator 22 may convert heat generated by a heater other than the fixing heater into DC power and supply the DC power to the load unit 24. Further alternatively, DC power obtained by converting light or vibrations other than heat into DC power may be supplied to the load unit 24. When one of such modifications is employed, the input/output controller 21 may preferably change the second time period depending on the heater other than the fixing heater or a member that emits the light or vibrations.

As illustrated in FIG. 6, the input/output controller 21 reduces the first time period such that, as the AC voltage detected by the AC detection circuit 20*a* decreases below the rated voltage, the first time period becomes shorter. In the embodiment, as illustrated in FIG. 6, the input/output controller 21 causes the first time period for the AC voltage dropped to or below 45 V to be shorter than that for the AC voltage in the range between 45 V exclusive and 75 V inclusive. As illustrated in FIG. 6, the input/output controller 21 causes the first time period for the AC voltage dropped to or below 15 V to be shorter than that for the AC voltage in the range between 15 V exclusive and 45 V inclusive. Setting the first time period in this way allows reducing the period of time over which DC power is supplied from the capacitor 20*c* in a condition where the AC voltage is low and the amount of electric power stored in the capacitor 20*c* is small. As a result, an undesirable situation that the capacitor 20*c* becomes incapable of supplying DC power before the DC power supply source is switched to the thermoelectric generator 22 can be prevented.

When the AC voltage detected by the AC detection circuit 20*a* rises back to be higher than the rated voltage, the input/output controller 21 resets the first elapsed time and the second elapsed time without changing the first time period and the second time period.

How the fixing heater included in the fixing device 9 is controlled during a period when the AC voltage detected by the AC detection circuit 20*a* is equal to or below the rated voltage is described below with reference to FIGS. 7 and 8. FIG. 7 is a diagram for describing control of the fixing heater in the image forming apparatus 1 according to the embodiment. FIG. 8 is a timing diagram of a process for controlling the fixing heater in the image forming apparatus 1 according to the embodiment.

When the AC voltage detected by the AC detection circuit 20*a* drops to or below the rated voltage, the input/output controller 21 turns off the fixing heater included in the fixing device 9 for a shorter one of a predetermined allowable heat-generation-stop time and the first elapsed time. This control allows preventing an undesirable situation that the AC voltage detected by the AC detection circuit 20*a* is varied by an inrush current at turn-on of the fixing heater after the AC voltage drops to or below the rated voltage as illustrated in FIG. 8. Furthermore, by thus maximizing the period during which AC power from the commercial power supply G is supplied only to the FSU 20 (more specifically, the DC-output-voltage generating circuit 20*b*), the period during which DC power is supplied from the DC-output-voltage generating circuit 20*b* can be prolonged. As a result, usage time and frequency of use of the power storage unit 31 can be reduced. Meanwhile, the predetermined allowable heat-generation-stop time is a period of time where fixability of toner image onto transfer paper remains unaffected even if a fixing roller included in the fixing device 9 is turned off throughout this period. In the embodiment, the predetermined allowable heat-generation-stop time is 1.0 seconds.

In the embodiment, when the image forming apparatus 1 is in the energy saving mode or the standby mode, the fixing device 9 is not performing a process of fixing a toner image onto transfer paper. Accordingly, because the fixing heater does not affect the fixing process, the input/output controller 21 keeps the fixing heater off until the AC voltage rises to be higher than the rated voltage as illustrated in FIG. 7. On the other hand, when the image forming apparatus 1 is in the in-service mode, the fixing device 9 is performing the process of fixing a toner image onto transfer paper. Accordingly, the input/output controller 21 turns off the fixing heater included in the fixing device 9 for a shorter one of the predetermined allowable heat-generation-stop time and the first elapsed time as illustrated in FIG. 7.

A process for setting the second time period performed by the image forming apparatus 1 according to the embodiment is described more specifically below with reference to FIG. 9. FIG. 9 is a diagram illustrating the process for setting the second time period performed by the image forming apparatus 1 according to the embodiment.

Target temperature of the fixing heater included in the fixing device 9 generally varies between the in-service mode and the standby mode. For instance, when the image forming apparatus 1 is in the in-service mode, the fixing device 9 turns on or off the fixing heater based on the temperature detected by the temperature detector 91 so that the fixing heater is maintained at a target temperature, 160° C. On the other hand, when the image forming apparatus 1 is in the standby mode, the fixing device 9 turns on or off the fixing heater based on the temperature detected by the temperature detector 91 so that the fixing heater is maintained at a target temperature, 140° C. Upper limit of the period of time over which the thermoelectric generator 22 can supply DC power is obtained by backward calculation of the temperature (in the embodiment, the target temperature) of the fixing heater.

Hence, in the embodiment, the input/output controller 21 calculates the upper limit of the period of time over which the thermoelectric generator 22 can supply DC power based on the target temperature (i.e., the temperature detected by the temperature detector 91) of the fixing heater included in the fixing device 9. The input/output controller 21 sets the second time period to the thus-obtained upper limit. Setting the second time period in this manner maximizes the period of time over which DC power is supplied from the thermoelectric generator 22 and, accordingly, reduces frequency of use of the power storage unit 31.

For instance, as illustrated in FIG. 9, when the image forming apparatus 1 is in the standby mode and the target temperature (fixing temperature) of the fixing heater is 150° C., the input/output controller 21 sets the second time period to 0.4 seconds which is upper limit of the period of time over which the thermoelectric generator 22 can supply DC power. On the other hand, as illustrated in FIG. 9, when the image forming apparatus 1 is in the standby mode and the target temperature (the fixing temperature) of the fixing heater is 140° C., the input/output controller 21 sets the second time period to 0.3 seconds which is upper limit of the period of time over which the thermoelectric generator 22 can supply DC power.

In the embodiment, the input/output controller 21 determines the upper limit of the period of time over which the thermoelectric generator 22 can supply DC power based on the temperature detected by the temperature detector 91. However, the method for determining the upper limit is not limited thereto. For instance, the upper limit of the period of time over which the thermoelectric generator 22 can supply DC power may be determined based on the amount of DC power generated by converting heat by the thermoelectric generator 22 by detecting the amount of the DC power.

Figure 10:
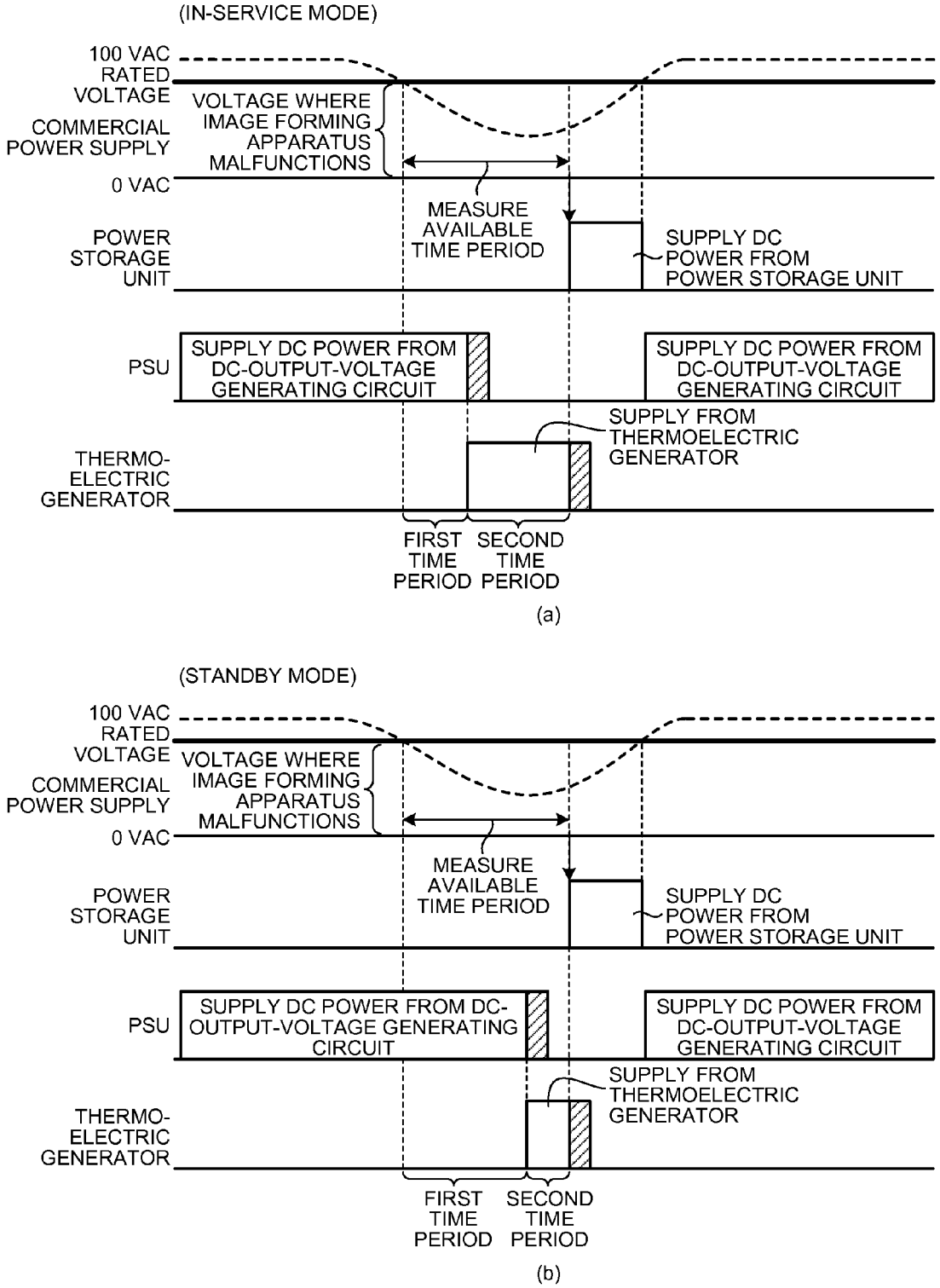
FIG. 10 illustrates timing diagrams of timing, which varies depending on operation mode, of DC-power supply from a PSU and a thermoelectric generator in the image forming apparatus according to the embodiment.

A process for setting the first time period and the second time period performed by the image forming apparatus 1 according to the embodiment on a per-operation-mode basis is described below with reference to FIG. 10. FIG. 10 illustrates timing diagrams of timing, which varies depending on operation mode, of DC-power supply from the PSU 20 and the thermoelectric generator 22 in the image forming apparatus 1 according to the embodiment.

When the image forming apparatus 1 is in the in-service mode, with regard to the input/output controller 21, the load unit 24 is performing printing or the like, and therefore load of the load unit 24 is high. Accordingly, in the in-service mode, as illustrated in (a) in FIG. 10, the input/output controller 21 causes the first time period, over which DC power is to be supplied from the DC-output-voltage generating circuit 20*b* of the PSU 20 after the AC voltage drops to or below the rated voltage, to be shorter than that in the standby mode (see (b) in FIG. 10).

When the image forming apparatus 1 is in the in-service mode, with regard to the input/output controller 21, the load unit 24 is performing printing or the like and therefore the target temperature (the fixing temperature) of the fixing heater of the fixing device 9 is high. Accordingly, in the in-service mode, as illustrated in FIG. 10A, the input/output controller 21 causes the second time period, which is the period of time between when the thermoelectric generator 22 starts supplying DC power to the load unit 24 and when the DC-power supply source for the load unit 24 is switched to the power storage unit 31, to be longer than that in the standby mode (see (b) in FIG. 10).

On the other hand, when the image forming apparatus 1 is in the standby mode, with regard to the input/output controller 21, the load unit 24 is not performing printing or the like and therefore the load of the load unit 24 is low. Accordingly, in the standby mode, as illustrated in FIG. 10B, the input/output controller 21 causes the first time period, over which DC power is to be supplied from the DC-output-voltage generating circuit 20*b* of the PSU 20 after the AC voltage drops to or below the rated voltage, to be longer than that in the in-service mode (see (a) in FIG. 10).

When the image forming apparatus 1 is in the standby mode, with regard to the input/output controller 21, the load unit 24 is not performing printing or the like and therefore the target temperature (the fixing temperature) of the fixing heater of the fixing device 9 is low. Accordingly, in the standby mode, as illustrated in (b) in FIG. 10, the input/output controller 21 causes the second time period, which is the period of time between when the thermoelectric generator 22 starts supplying DC power to the load unit 24 and when the DC-power supply source for the load unit 24 is switched to the power storage unit 31, to be shorter than that in the in-service mode (see (a) in FIG. 10).

Figure 11:
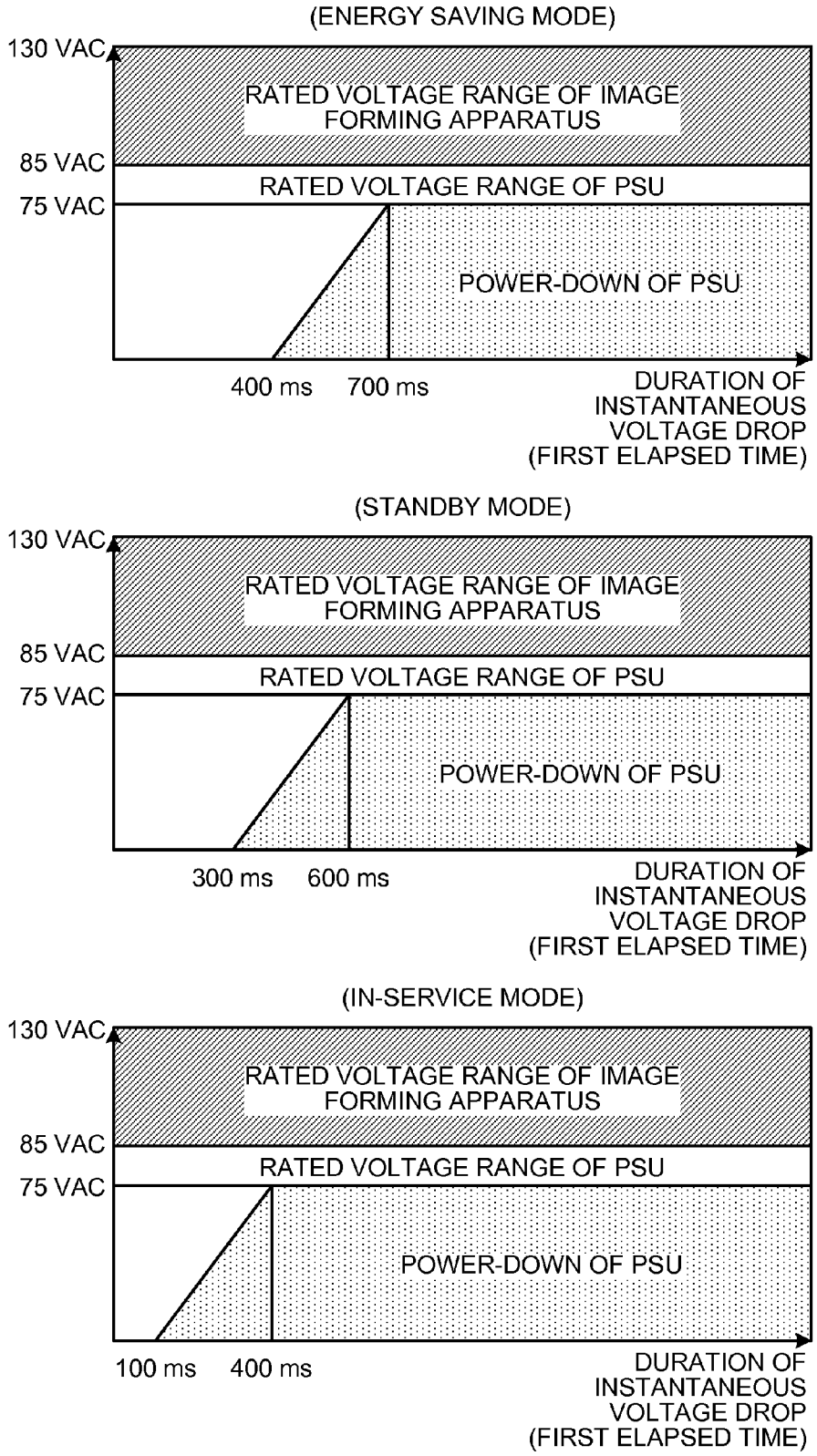
FIG. 11 is a diagram illustrating variation, among operation modes, in time period until the PSU powers down in the image forming apparatus according to the embodiment.

Variation, among the operation modes, in the period of time over which the PSU 20 (more specifically, the DC-output-voltage generating circuit 20*b*) can continue supplying DC power at occurrence of instantaneous voltage drop (in other words, the period of time between when the instantaneous voltage drop occurs and when the PSU 20 powers down and becomes incapable of supplying DC power) is described below with reference to FIG. 11. FIG. 11 is a diagram for describing the variation, among the operation modes, in the period of time until the PSU 20 powers down in the image forming apparatus 1 according to the embodiment. Each vertical axis of FIG. 11 indicates the AC voltage of the commercial power supply G. Each horizontal axis of FIG. 11 indicates duration of instantaneous voltage drop (in other words, the first elapsed time after the AC voltage drops to or below the rated voltage).

When the image forming apparatus 1 is in the energy saving mode, the load unit 24 is not operating, and therefore the load of the load unit 24 is low. Accordingly, the time period over which the DC-output-voltage generating circuit 20*b* of the PSU 20 can supply DC power to the load unit 24 after the AC voltage drops to or below the rated voltage (in short, after occurrence of instantaneous voltage drop) is long (e.g., 700 milliseconds after occurrence of the instantaneous voltage drop). When the image forming apparatus 1 is in the standby mode, the load of the load unit 24 is higher than that in the energy saving mode. Accordingly, the time period over which the DC-output-voltage generating circuit 20*b* of the PSU 20 can supply DC power to the load unit 24 after occurrence of instantaneous voltage drop is shorter (e.g., 600 milliseconds after occurrence of the instantaneous voltage drop) than that in the energy saving mode. Furthermore, when the image forming apparatus 1 is in the in-service mode, the load of the load unit 24 is higher than that in the standby mode. Accordingly, the time period over which the DC-output-voltage generating circuit 20*b* of the PSU 20 can supply DC power to the load unit 24 after occurrence of instantaneous voltage drop is still shorter (e.g., 400 milliseconds after occurrence of the instantaneous voltage drop) than that in the standby mode.

In light of the above, in the embodiment, the input/output controller 21 reduces the first time period depending on operation mode such that, as the load of the load unit 24 increases, the first time period becomes shorter. Setting the first time period in this manner increases the time period over which DC power is supplied from the thermoelectric generator 22 to the load unit 24 when the image forming apparatus 1 is operating in a low-load mode, thereby reducing usage time and frequency of use of the power storage unit 31. As a result, usable life of the power storage unit 31 can be prolonged.

As described above, in the image forming apparatus 1 according to the embodiment, even when the AC voltage of the commercial power supply C drops to or below the rated voltage, the DC-power supply source for the load unit 24 is not switched to the power storage unit 31 immediately. Accordingly, because usage time and frequency of use of the power storage unit 31 are reduced, usable life of the power storage unit 31 can be prolonged, and running cost of the power storage unit 31 can be reduced.

The program to be executed by the image forming apparatus 1 of the embodiment may be provided as being stored in advance in a ROM (read only memory) or the like. The program to be executed by the image forming apparatus 1 of the embodiment may be configured to be provided as a file of an installable format or an executable format recorded in a computer-readable storage medium such as a CD-ROM, an ED (flexible disk), a CD-R, or a DVD (digital versatile disk).

The program to be executed by the image forming apparatus 1 of the embodiment may be configured to be stored in a computer connected to a network such as the Internet and provided by being downloaded via the network. The program to be executed by the image forming apparatus 1 of the embodiment may be configured to be provided or distributed via a network such as the Internet.

The program to be executed by the image forming apparatus 1 of the embodiment is configured as modules including the elements (such as the input/output controller 21) described above. From a viewpoint of actual hardware, a CPU (central processing unit) reads out the program from the ROM and executes the program to load the elements on a main memory, thereby generating the input/output controller 21 on the main memory.

In the embodiment, an example in which an image forming apparatus according to an aspect of the present invention is applied to a multifunction peripheral having at least two functions of the copier function, the printer function, the scanner function, and the facsimile function is described. However, the present invention is applicable to any image forming apparatus such as a copier, a printer, a scanner, or a facsimile.

An aspect of the present invention allows reducing usage time and frequency of use of a power storage unit, thereby prolonging usable life of the power storage unit and reducing running cost of the power storage unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a heat generator configured to generate heat depending on operation of the image forming apparatus;

a converter configured to convert AC power supplied from an external power supply into DC power and including a capacitor for smoothing the DC power, the converter being configured to supply the smoothed DC power to a load unit;

a thermoelectric transducer configured to convert the heat generated by the heat generator into DC power and supply the DC power to the load unit in place of the converter;

a detector configured to detect a voltage of the AC power supplied from the external power supply; and a controller configured to, when a first elapsed time that is a period of time elapsed since the voltage detected by the detector drops to or below a rated voltage is equal to or shorter than a first time period that is shorter than an upper limit of a period of time over which the capacitor is dischargeable, cause the converter to continue supplying the DC power to the load unit, and when the first elapsed time exceeds the first time period, cause the thermoelectric transducer to supply the DC power to the load unit.

2. The image forming apparatus according to claim 1, further comprising a power storage unit, wherein the controller causes, when a second elapsed time that is a period of time elapsed since the thermoelectric transducer starts supplying DC power to the load unit reaches a second time period that is a period of time over which the thermoelectric transducer can supply DC power to the load unit, the power storage unit in place of the thermoelectric transducer to supply the DC power to the load unit.

3. The image forming apparatus according to claim 2, wherein the controller sets the first time period of the image forming apparatus operating in a first mode to be longer than the first time period of the image forming apparatus operating in a second mode, load of the load unit in the second mode being larger than load of the load unit in the first mode.

4. The image forming apparatus according to claim 2, wherein the controller determines an upper limit of a period of time over which the thermoelectric transducer can supply DC power, based on temperature of the heat generator and sets the second time period to the upper limit.

5. The image forming apparatus according to claim 2, wherein the controller reduces the first time period such that, as the voltage detected by the detector decreases below the rated voltage, the first time period becomes shorter.

6. The image forming apparatus according to claim 1, wherein the heat generator generates heat by the AC power supplied from the external power supply, and the controller turns off, when the voltage detected by the detector drops to or below the rated voltage, the heat generator for a shorter one of a predetermined allowable heat-generation-stop time and the first elapsed time.

7. An image forming method performed in an image forming apparatus that includes a heat generator configured to generate heat depending on operation of the image forming apparatus, a converter configured to convert AC power supplied from an external power supply into DC power and including a capacitor for smoothing the DC power, the converter being configured to supply the smoothed DC power to a load unit, and a thermoelectric transducer configured to convert the heat generated by the heat generator into DC power and supply the DC power to the load unit in place of the converter, the image forming method comprising:

detecting a voltage of the AC power supplied from the external power supply;

causing, when a first elapsed time that is a period of time elapsed since the detected voltage drops to or below a rated voltage is equal to or shorter than a first time period that is shorter than an upper limit of a period of time over which the capacitor is dischargeable, the converter to continue supplying the DC power to the load unit; and causing, when the first elapsed time exceeds the first time period, the thermoelectric transducer to supply the DC power to the load unit.

8. A non-transitory computer-readable storage medium with an executable program stored thereon and executed by a computer for controlling an image forming apparatus that includes a heat generator configured to generate heat depending on operation of the image forming apparatus, a converter configured to convert AC power supplied from an external power supply into DC power and including a capacitor for smoothing the DC power, the converter being configured to supply the smoothed DC power to a load unit, and a thermoelectric transducer configured to convert the heat generated by the heat generator into DC power and supply the DC power to the load unit in place of the converter, wherein the program instructs the processor to perform:

detecting a voltage of the AC power supplied from the external power supply;

causing, when a first elapsed time that is a period of time elapsed since the detected voltage drops to or below a rated voltage is equal to or shorter than a first time period that is shorter than an upper limit of a period of time over which the capacitor is dischargeable, the converter to continue supplying the DC power to the load unit; and causing, when the first elapsed time exceeds the first time period, the thermoelectric transducer to supply the DC power to the load unit.

* * * * *